US006086195A

United States Patent [19]

Bohorquez et al.

[11] Patent Number: 6,086,195

[45] Date of Patent: Jul. 11, 2000

[54] FILTER FOR AN INKJET PRINTHEAD

[75] Inventors: Jaime H. Bohorquez, Escondido; Winthrop D. Childers, San Diego, both of Calif.

[73] Assignee: Hewlett-Packard Company, Palo Alto, Calif.

[21] Appl. No.: 09/159,982

[22] Filed: Sep. 24, 1998

[51] Int. Cl.[7] ..... B41J 2/175

[52] U.S. Cl. ..... 347/93

[58] Field of Search ..... 347/85, 86, 87, 347/18, 93

[56] References Cited

U.S. PATENT DOCUMENTS

| | | | |
|---|---|---|---|
| 4,864,329 | 9/1989 | Kneezel et al. | 347/93 |
| 5,017,941 | 5/1991 | Drake | 347/67 |
| 5,066,964 | 11/1991 | Fukuda et al. | 347/18 |
| 5,084,713 | 1/1992 | Wong | 347/18 |
| 5,121,130 | 6/1992 | Hempel | 347/18 |
| 5,124,717 | 6/1992 | Campanelli | 347/93 |
| 5,157,468 | 10/1992 | Matsumoto | 357/17 |
| 5,272,491 | 12/1993 | Asakawa et al. | 347/18 |
| 5,374,944 | 12/1994 | Janosky et al. | 347/223 |
| 5,399,265 | 3/1995 | Nehls | 210/490 |
| 5,486,848 | 1/1996 | Ayata et al. | 347/15 |
| 5,488,401 | 1/1996 | Mochizuki et al. | 347/86 |
| 5,489,930 | 2/1996 | Anderson | 347/71 |
| 5,623,292 | 4/1997 | Shrivastava et al. | 347/18 |
| 5,657,061 | 8/1997 | Seccombe et al. | 347/18 |
| 5,821,965 | 10/1998 | Oda et al. | 347/86 |
| 5,852,454 | 12/1998 | Kanematsu et al. | 347/40 |

*Primary Examiner*—N. Le
*Assistant Examiner*—Michael Nghiem

[57] ABSTRACT

This present invention is embodied in a printing system for a printhead portion of an inkjet printer. The printing system of the present invention includes a filter, coupled between an ink supply and an inkjet printhead. A filter member having a plurality of holes can be coupled between the ink supply and the microscreen filter. Alternatively, the filter can be a thermally efficient filter comprised of a filter integrated with a heat transfer device and can be coupled to the inkjet printhead.

15 Claims, 6 Drawing Sheets

FILTER FOR AN INKJET PRINTHEAD

FIELD OF THE INVENTION

The present invention generally relates to inkjet and other types of printers and more particularly, to printing systems with microfine filtration systems and thermally efficient filtration systems for a printhead portion of an inkjet printer.

BACKGROUND OF THE INVENTION

Inkjet printers are commonplace in the computer field. These printers are described by W. J. Lloyd and H. T. Taub in "Ink Jet Devices," Chapter 13 of *Output Hardcopy Devices* (Ed. R. C. Durbeck and S. Sherr, San Diego: Academic Press, 1988) and U.S. Pat. Nos. 4,490,728 and 4,313,684. Inkjet printers produce high quality print, are compact and portable, and print quickly and quietly because only ink strikes a printing medium, such as paper.

An inkjet printer produces a printed image by printing a pattern of individual dots at particular locations of an array defined for the printing medium. The locations are conveniently visualized as being small dots in a rectilinear array. The locations are sometimes "dot locations", "dot positions", or "pixels". Thus, the printing operation can be viewed as the filling of a pattern of dot locations with dots of ink.

Inkjet printers print dots by ejecting very small drops of ink onto the print medium and typically include a movable carriage that supports one or more print cartridges each having a printhead with ink ejecting nozzles. The carriage traverses over the surface of the print medium. An ink supply, such as an ink reservoir, supplies ink to the nozzles. The nozzles are controlled to eject drops of ink at appropriate times pursuant to command of a microcomputer or other controller. The timing of the application of the ink drops is intended to correspond to the pattern of pixels of the image being printed.

In general, the small drops of ink are ejected from the nozzles through orifices by rapidly heating a small volume of ink located in vaporization chambers with small electric heaters, such as small thin film resistors. The small thin film resistors are usually located adjacent the vaporization chambers. Heating the ink causes the ink to vaporize and be ejected from the orifices.

Specifically, for one dot of ink, an electrical current from an external power supply is passed through a selected thin film resistor of a selected vaporization chamber. The resistor is then heated for superheating a thin layer of ink located within the selected vaporization chamber, causing explosive vaporization, and, consequently, a droplet of ink is ejected through an associated orifice of the printhead.

However, there are several concerns that exist for controlling inkjet quality. First, as each droplet of ink is ejected from the printhead, some of the heat used to vaporize the ink driving the droplet is retained within the printhead. This heat can gradually build, eventually altering ejection performance. Namely, printhead overheating can occur when numerous nozzles are being fired during high density printing or when the firing frequency is increased during high speed printing. If the printhead reaches an overheating threshold temperature, print quality will be degraded and the inkjet printing process will be compromised. In fact, an increase in printhead temperature over the threshold temperature is directly related to an increase in dot or pixel size, which creates uneven printed dots or pixels, and thus, poor print quality. In addition, in extreme cases, an overheated printhead can cause the nozzles to misfire or cease from firing completely, thereby severely impairing further operation. Therefore, heat regulation is an important factor for controlling print capacity, output quality, and speed of most inkjet printers.

Next, since the printhead nozzles have relatively small flow areas, the nozzles are susceptible to clogging from contaminant particles. In addition, during high capacity or high speed printing, the sensitivity to fine particles is increased. One source of particulate contamination is from printhead manufacturing and assembly. Also, the ink and ink supply can contain particulate contamination. Although filters have been used, many either do not filter enough or micro fine particulate contamination, or are too restrictive, thereby hindering the ink flow, which can compromise print quality and print speed. As such, higher print quality can be achieved if the nozzles are free from particulate contamination and ink flow is not unduly restricted by a filtration system.

Therefore, what is needed is a thermally efficient filtration system for a printhead portion of an inkjet printer that can regulate printhead temperatures and filter particulate contamination without unduly restricting ink flow. What is, also needed is a thermally efficient filtration system that operates at very high throughput rates.

SUMMARY OF THE INVENTION

To overcome the limitations in the prior art described above, and to overcome other limitations that will become apparent upon reading and understanding the present specification, the present invention is embodied in a printing system with a filtration system, that is optionally thermally efficient, for a printhead portion of an inkjet printer.

The printing system of the present invention includes a filter, preferably a microscreen filter, coupled between an ink supply and an inkjet printhead. A filter member having a plurality of holes can be coupled between the ink supply and the microscreen filter. Alternatively, the filter can be a thermally efficient filter comprised of a filter thermally connected to a heat transfer device or a filter integrated with a heat transfer device for removing heat from the printhead.

In one embodiment, the printing system of the present invention efficiently filters fine particulate contamination without restricting ink flow by minimizing fluidic losses. In another embodiment, the printing system of the present invention achieves thermal efficiency by regulating printhead temperatures while also filtering particulate contamination. As a result, in both embodiments, very high throughput rates can be achieved for inkjet printheads due to the fine filtration, without ink flow restriction, and the thermal efficiency produced by the present invention.

BRIEF DESCRIPTION OF THE DRAWINGS

The present invention can be further understood by reference to the following description and attached drawings that illustrate the preferred embodiment. Other features and advantages will be apparent from the following detailed description of the preferred embodiment, taken in conjunction with the accompanying drawings, which illustrate, by way of example, the principles of the invention.

DETAILED DESCRIPTION OF THE PREFERRED EMBODIMENTS

In the following description of the invention, reference is made to the accompanying drawings, which form a part hereof, and in which is shown by way of illustration a specific example in which the invention may be practiced. It is to be understood that other embodiments may be utilized and structural changes may be made without departing from the scope of the present invention.

General Overview

Figure 1:
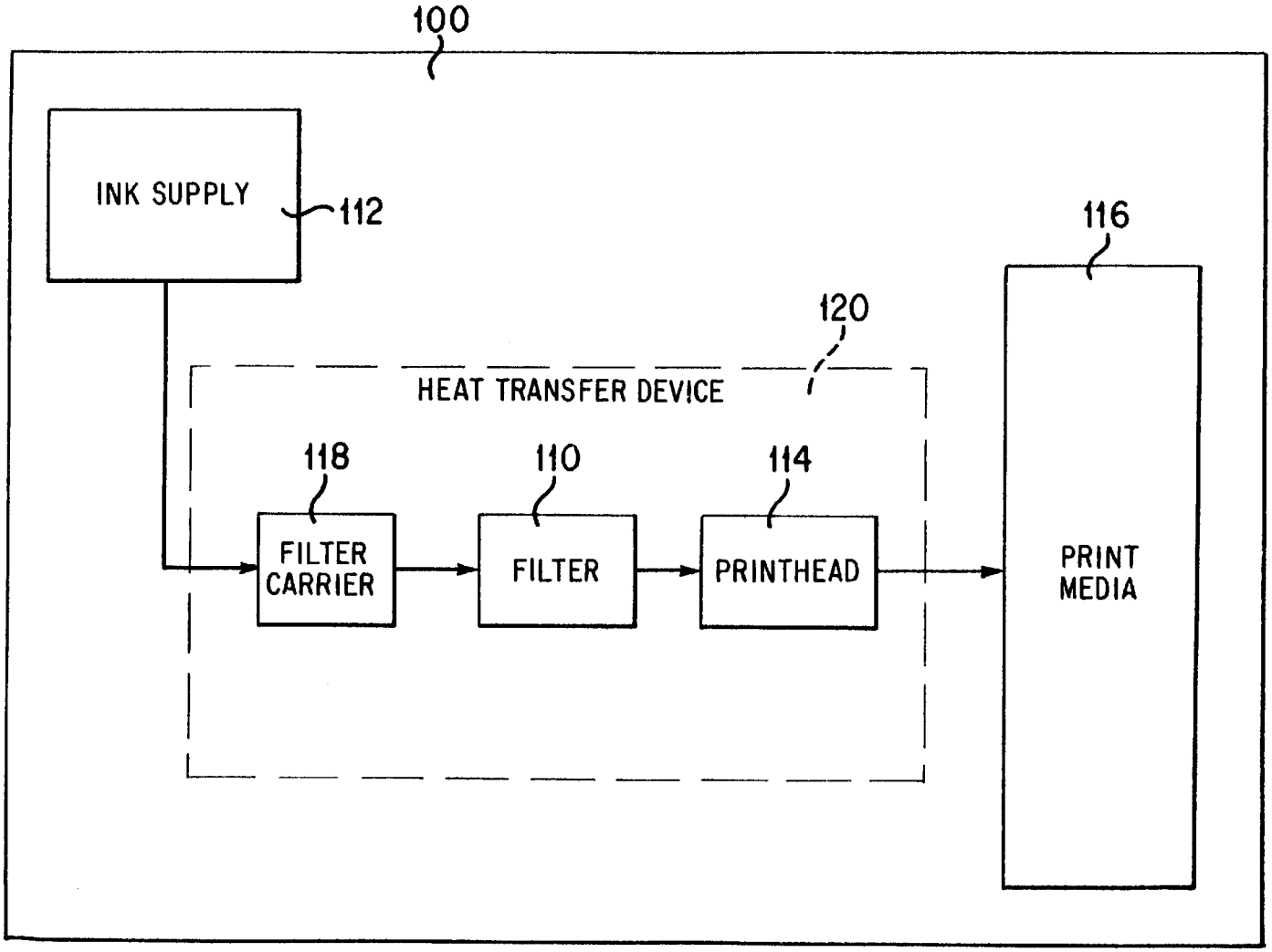
FIG. 1 shows a block diagram of an overall printing system incorporating the present invention.

FIG. 1 shows a block diagram of an overall printing system incorporating the present invention. The printing system 100 of the present invention includes a filter 110 coupled between an ink supply 112 and an inkjet printhead 114. The printhead 114 produces droplets of ink that are printed on a print media 116 to form a desired pattern for generating text and images on the print media 116. The filter is preferably a microscreen filter having a plurality of microfine apertures. The microscreen filter is suitably structured to filter fine particulate contamination without restricting ink flow by minimizing fluidic losses, thereby allowing very high throughput printing.

An optional filter member 118 having a plurality of holes can be coupled between the ink supply 112 and the filter 110. In a preferred embodiment, the filter member 118 is a filter carrier 118 adapted to provide stability and support to the microscreen filter. Filter carrier 118 can be positioned upstream or downstream of filter 110, relative to a flow of ink from ink supply 112 to printhead 114. The holes of the filter carrier 118 are preferably larger than the microfine apertures of the microscreen filter, and hence, fluidic loses are minimized and ink flow is not unduly restricted. The description below describes the microscreen filter and the filter carrier in detail.

In an alternate embodiment, filter member 118 is a prefilter 118 that is utilized to filter out larger particles from the ink before the ink reaches filter 110. Such a prefilter can be utilized to prevent filter 110 from becoming occluded with large particles. Such a prefilter 118 could still be attached to filter 110 to provide mechanical support, but this is not necessarily the case.

In another alternative embodiment, the filter 110 is a thermally efficient filter comprised of a filter thermally coupled to a heat transfer device 120 or a filter integrated with a heat transfer device 120. In both cases, the heat transfer device 120 is thermally coupled to the filter 110, printhead 114 and filter carrier 118, as shown in FIG. 1. Thermal efficiency is achieved by regulating printhead temperatures with the heat transfer device 120, while also filtering unwanted particles. As a result, the present invention prevents printhead overheating and reduces particulate contamination to allow very high throughput or ink flow rates for an inkjet printer.

Exemplary Printing System

Figure 2:
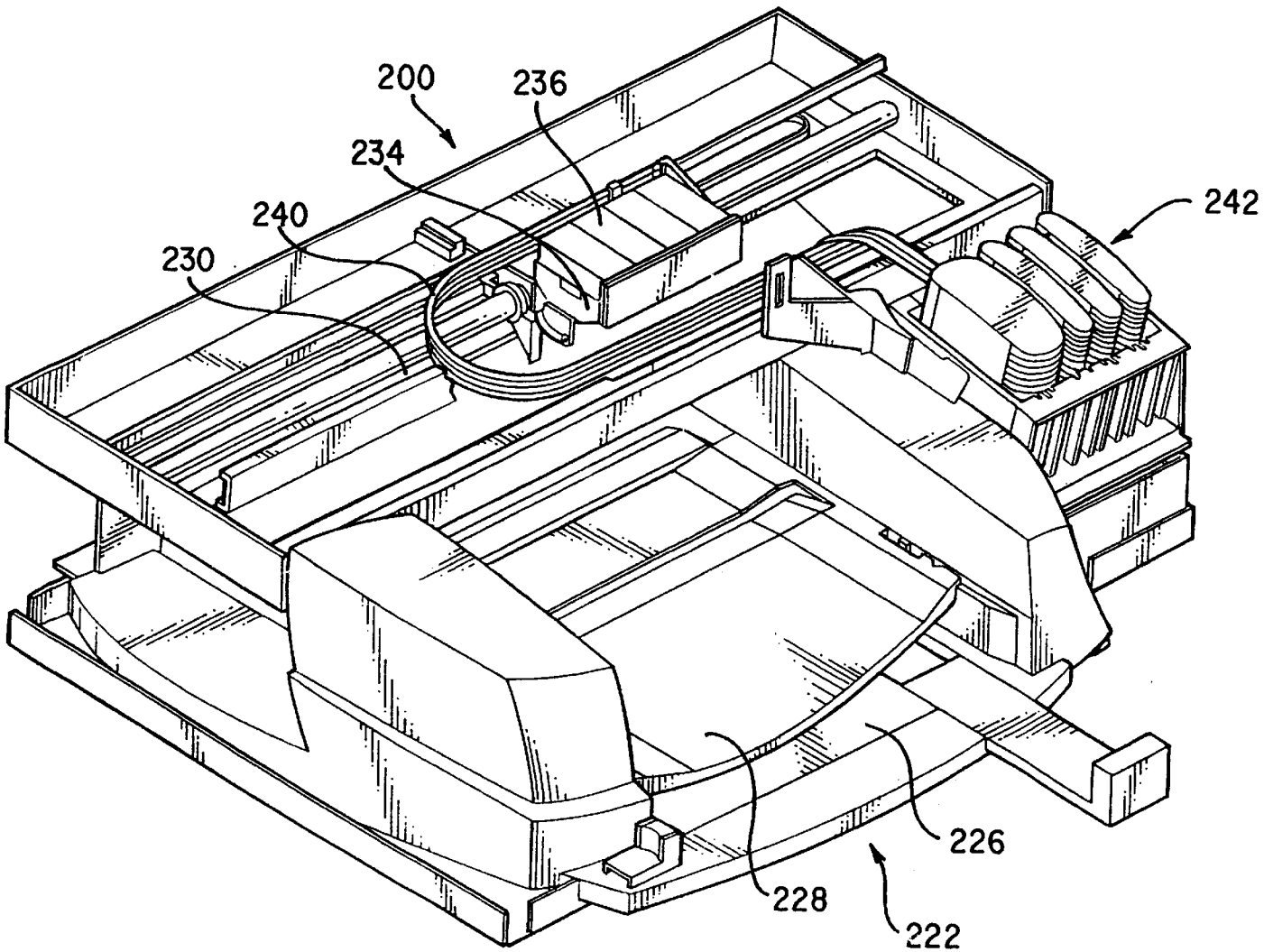
FIG. 2 is an exemplary high-speed printer that incorporates the invention and is shown for illustrative purposes only.

FIG. 2 is an exemplary high-speed printer that incorporates the invention and is shown for illustrative purposes only. Generally, printer 200 includes a tray 222 for holding print media 116 (shown in FIG. 1). When a printing operation is initiated, print media 116, such as a sheet of paper, is fed into printer 200 from tray 222 preferably using a sheet feeder 226. The sheet then brought around in a U direction and travels in an opposite direction toward output tray 228. Other paper paths, such as a straight paper path, can also be used. The sheet is stopped in a print zone 230, and a scanning carriage 234, supporting one or more print cartridges 236, is then scanned across the sheet for printing a swath of ink thereon. After a single scan or multiple scans, the sheet is then incrementally shifted using, for example, a stepper motor and feed rollers to a next position within the print zone 230. Carriage 234 again scans across the sheet for printing a next swath of ink. The process repeats until the entire sheet has been printed, at which point it is ejected into output tray 228.

The present invention is equally applicable to alternative printing systems (not shown) such as those incorporating grit wheel or drum technology to support and move the print media 116 relative to the printhead 114. With a grit wheel design, a grit wheel and pinch roller move the media back and forth along one axis while a carriage carrying one or more printheads scans past the media along an orthogonal axis. With a drum printer design, the media is mounted to a rotating drum that is rotated along one axis while a carriage carrying one or more printheads scans past the media along an orthogonal axis. In either the drum or grit wheel designs, the scanning is typically not done in a back and forth manner as is the case for the system depicted in FIG. 2.

The print cartridges 236 may be removeably mounted or permanently mounted to the scanning carriage 234. Also, the print cartridges 236 can have sell-contained ink reservoirs (shown in FIG. 4) as the ink supply 112 (shown in FIG. 1). The self-contained ink reservoirs can be refilled with ink for reusing the print cartridges 236. Alternatively, the print cartridges 236 can be each fluidically coupled, via a flexible conduit 240, to one of a plurality of fixed or removable ink containers 242 acting as the ink supply 112 (shown in FIG. 1). As a further alternative, ink supplies 112 can be one or more ink containers separate or separable from print cartridges 236 and removeably mountable to carriage 234.

Figure 3:
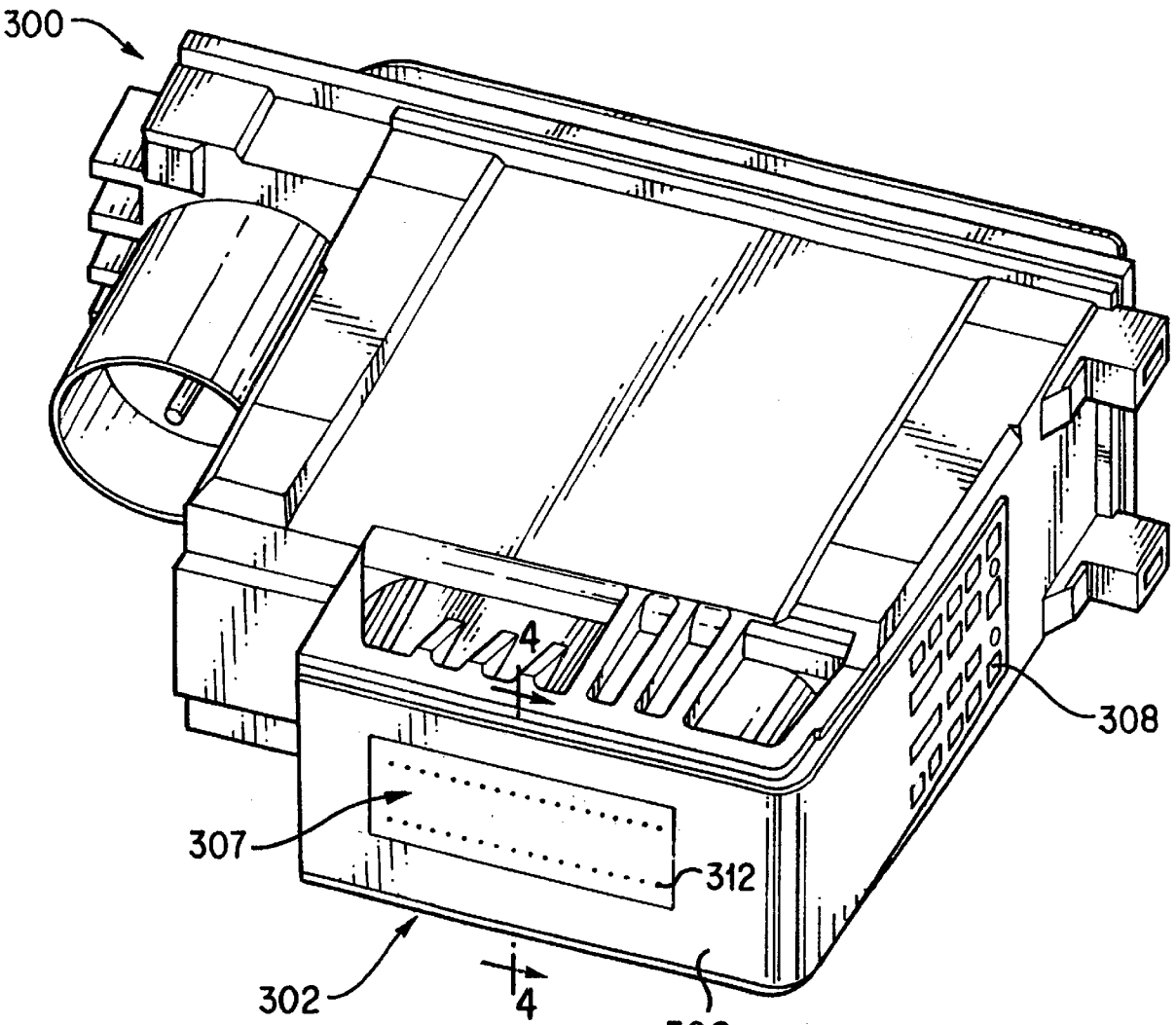
FIG. 3 shows for illustrative purposes only a perspective view of an exemplary print cartridge incorporating the present invention.

FIG. 3 shows for illustrative purposes only a perspective view of an exemplary print cartridge 300 incorporating the present invention. Referring to FIGS. 1 and 2 along with FIG. 3, a flexible tape 306, such as a Tape Automated Bonding (TAB) printhead assembly 302, containing a nozzle member 307 and contact pads 308 is secured to the print cartridge 300. An integrated circuit chip (not shown) provides feedback to the printer 200 regarding certain parameters of print: cartridge 300. The contact pads 308 align with and electrically contact electrodes (not shown) on carriage 234. The nozzle member 307 preferably contains plural parallel rows of offset nozzles 312 through the tape 306 created by, for example, laser ablation.

Component Details

Figure 4:
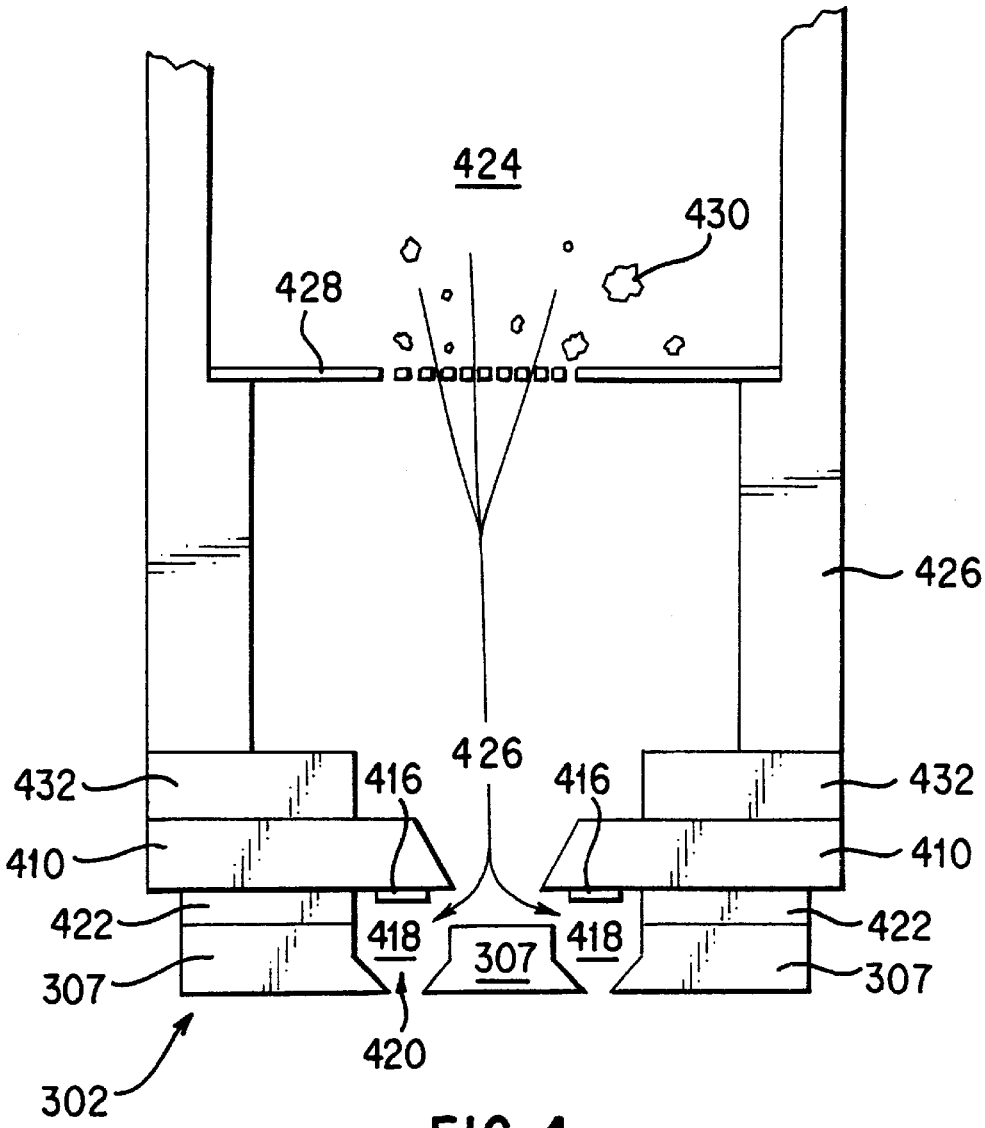
FIG. 4 is a schematic cross-sectional view taken along line 4—4 of FIG. 3 showing the filtration mechanism and heat transfer device of the print cartridge of FIG. 3 as well as the ink flow path.

FIG. 4 is a cross-sectional schematic of the inkjet print cartridge 300 utilizing the present invention. A detailed description of the present invention follows with reference to a typical printhead used with print cartridge 300. However, the present invention can be incorporated in any printhead configuration. Also, the elements of FIG. 4 are not to scale and are exaggerated for simplification.

Referring to FIGS. 1–3 along with FIG. 4, as discussed above, conductors (not shown) are formed on the back of tape 306 and terminate in contact pads 308 for contacting electrodes on carriage 234. The other ends of the conductors are bonded to the printhead 302 via terminals or electrodes (not shown) of a substrate 410. The substrate 410 has ink ejection elements 416 formed thereon and electrically coupled to the conductors. The integrated circuit chip provides the ink ejection elements 416 with operational electrical signals.

An ink ejection or vaporization chamber 418 is adjacent each ink ejection element 416, as shown in FIG. 4, so that each ink ejection element 416 is located generally behind a single orifice 420 of the nozzle member 307. Also, a barrier layer 422 is formed on the surface of the substrate 410 near the vaporization chambers 418, preferably using photolithographic techniques, and can be a layer of photoresist or some other polymer. A portion of the barrier layer 422 insulates the conductive traces from the underlying substrate 410.

Each ink ejection element 416 acts as ohmic heater when selectively energized by one or more pulses applied sequentially or simultaneously to one or more of the contact pads 308 via the integrated circuit. The ink ejection elements 416 may be heater resistors or piezoelectric elements. The orifices 420 may be of any size, number, and pattern, and the various figures are designed to simply and clearly show the features of the invention. The relative dimensions of the various features have been greatly adjusted for the sake of clarity.

Referring to FIGS. 1–4, in operation, ink stored in an the ink reservoir 424 defined by housing 426 generally flows around the edges of the substrate 410 and into the vaporization chambers 418, as shown by arrow 426. Energization signals are sent to the ink ejection elements 416 and are produced from the electrical connection between the print cartridges 236 and the printer 200. Upon energization of the ink ejection elements 416, a thin layer of adjacent ink is superheated to provide explosive vaporization and, consequently, cause a droplet of ink to be ejected through the orifice 420. The vaporization chamber 418 is then refilled by capillary action. This process enables selective deposition of ink on print media 116 to thereby generate text and images.

However, in typical inkjet printers, as each droplet of ink is ejected from the printhead, some of the heat used to vaporize the ink driving the droplet is retained within the printhead and for high flow rates, fluidic friction can heat the ink near the substrate. These actions can overheat the printhead, which can degrade print quality, cause the nozzles to misfire, or can cause the printhead to stop firing completely. In addition, since the printhead nozzles have relatively small flow areas, the nozzles are susceptible to clogging from contaminant particles. Printhead overheating and particulate contamination compromises the inkjet printing process and limits high throughput printing. The present invention solves these problems by preventing the printhead from overheating and filtering particulate contamination to prevent nozzle clogging by minimizing fluidic losses without unduly restricting ink flow, thereby allowing high throughput printing.

Specifically, a filter 428 is fluidically coupled to the printhead 302. For illustrative purposes only, the filter 428 is shown in FIG. 4 to be located between the ink supply (ink reservoir 424) and the printhead 302 and is adapted to filter particulate contamination 430. Also, a heat transfer device 432 can be thermally coupled to the printhead 302. For illustrative purposes only, the heat transfer device 430 is shown in FIG. 4 to be in direct contact with the substrate 410, which allows heat to be removed from the substrate 410. The heat transfer device 432 can be selected from a number of alternative devices, such as heat pipes, cooling fins, heat sinks, etc., or any combination thereof. Further, to enhance heat transfer, forced convection via a fan or source of coolant (not shown) can be provided in combination with the heat transfer device.

Although a particular printhead has been described, this invention can be utilized for any of a number of other printhead designs such as: (1) an "edge feed" printhead having ink flowing over the outer edges of the substrate prior to reaching the ink ejection elements; (2) an "edge shooter" printhead that ejects droplets of ink in a direction parallel to surface of the substrate supporting the ink ejection elements; (3) piezoelectric printheads.

Microscreen Filter

Figure 5:
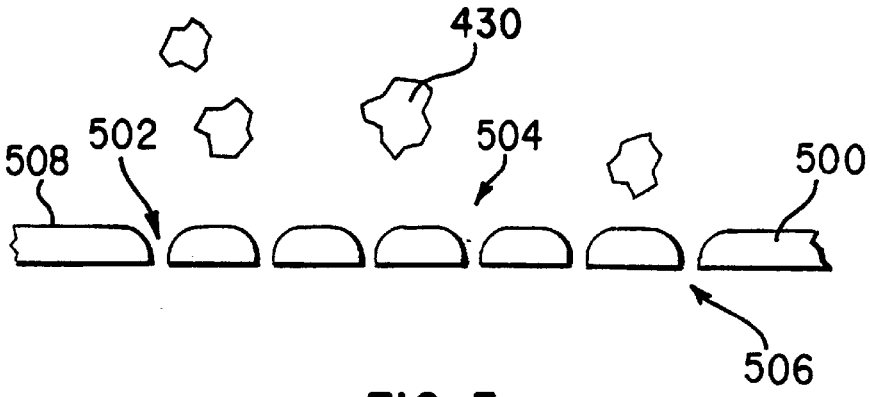
FIG. 5 is a cross-sectional detailed side view of the filter of FIG. 4 as an electroformed filtration mechanism.

FIG. 5 is a sectional side view of the filter of FIG. 4 as a microscreen filtration mechanism. The filter 428 of FIG. 4 can be a microscreen filter 500 with micron sized apertures (micro apertures) 502, such as a metal sheet microscreen with uniformly distributed electroformed apertures or a silicon wafer with fabricated micro apertures. The microscreen filter 500 is sensitive to fine particles, which are increasingly present with increased flow rates. Thus, the micro apertures filter fine particulate contamination 430 from ink flowing at high rates from an inlet side 504 to an outlet side 506 of the filter 500. For the metal sheet microscreen, the apertures are formed by an electrochemical process. The electrochemical process preferably produces a taper in the micro aperture 502 from a larger diameter at the inlet side 504 to a smaller diameter at the outlet side 506. An electroforming process is one electrochemical process that can be used to produce the micro apertures 502.

With a typical electroforming process, first a glass plate photo master with the micro aperture pattern is created. Each aperture is represented in the form of a dot. Next, the micro aperture pattern is transferred to a metal sheet, such as a stainless steel sheet. One way to do this is to coat the metal sheet with photoresist, expose the photoresist with a UV light using the photomask to block the light wherever an opening is desired, and then to develop the photoresist. This results in an array of photoresist dots defined over the surface of the metal sheet. Last, the micro apertures are formed by electroplating metal, such as nickel, onto the stainless steel sheet. The metal electroplates the exposed regions of the metal such that the photoresist dots define apertures. The plated metal has a tapered edge at the boundary of each photoresist dot. Thus, this process can be used to produce tapered apertures of extremely small dimension, such as apertures having an exit diameter of 10–50 microns or less, to enable the filtration of extremely fine particles that would otherwise reach vaporization chambers 418. However, as the apertures become very small and close together and the filter becomes thinner, the filter material becomes quite fragile and difficult to handle when assembling printhead 302.

For the silicon wafer filter, the micro apertures are formed by a silicon fabrication process such as etching.

Figure 6A:
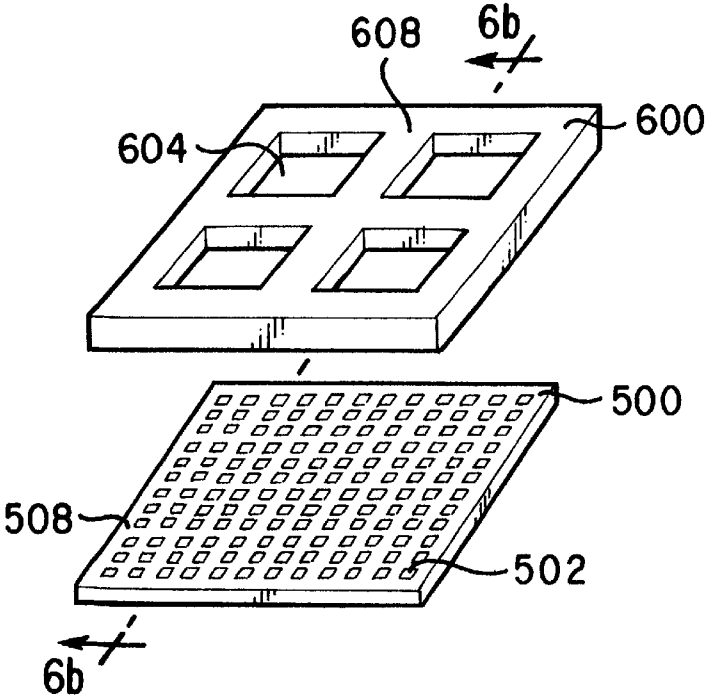
FIG. 6*a* is an exploded view of an alternative filtration mechanism with a filter carrier.

FIG. 6*a* is an exploded view of an alternative filtration mechanism with a filter carrier. A filter carrier 600 can be coupled between the ink supply 424 of FIG. 4 and the microscreen filter 500. The filter carrier 600 is adapted to provide stability, support, and reinforcement to the microscreen filter 500. As such, the filter carrier 600 is preferably made of a material, such as stainless steel, to provide the suitable support and reinforcement to the microscreen filter 500 and also is securely coupled to the microscreen filter 500.

Figure 6B:
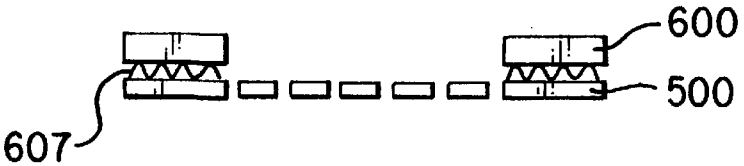
FIG. 6*b* is a sectional side view along line 6*b*—6*b* of the alternative filtration mechanism with a filter carrier of FIG. 6*a*.

FIG. 6*b* is a sectional side view along line 6*b*—6*b* of the alternative filtration mechanism with a filter carrier of FIG. 6*a*. Since the filter carrier 600 is intended to provide stability, support, and reinforcement to the microscreen filter 500, the filter carrier 600 is preferably adhesively or mechanically bonded to the microscreen filter 500. For instance, as shown in FIG. 6*b*, an adhesive 607 can be used to bond the filter carrier 600 to the microscreen filter 500.

The filter carrier 600 preferably contains a plurality of holes 604 larger than the micro apertures 502 of the microscreen filter 500 for providing fluid communication between the filter carrier 600 and the microscreen filter 500. Also, the plurality of holes 604 can be spaced apart to define thickened regions 608. These thickened regions 608 overcome any fragility problems that might be associated with the microscreen filter 500 as a micro thin sheet. The microscreen filter 500 and filter carrier 600 combination of FIGS. 6*a* and 6*b* provide stable and reinforced filtration of microfine particulate contamination without undue ink flow restriction by minimizing fluidic losses.

Alternatively, the holes 604 can be sized to provide a prefiltering function, wherein larger particles are removed from the ink before the ink reaches micro apertures 502.

Another embodiment is now described with respect to FIG. 6*b*. One way to form the device is to start with a first layer 500 of a material such as silicon, glass, or ceramic. Next, a second layer 500 that is preferably a thin film layer such as a metal or oxide is deposited on the non-metallic material 600. Thin film methods available for the deposition of layer 500 include chemical vapor deposition or a sputtering process. The thin film layer 500 is then patterned, forming the micro apertures 502. A patterning process such as the photoresist process described with respect to FIG. 5 can be used. Holes 604 can be formed by various processes including laser drilling or chemical etching.

Figure 7A:
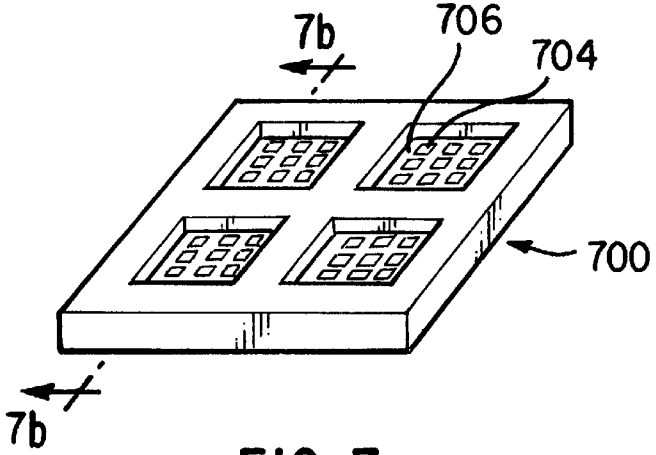
FIG. 7*a* is a perspective view of an alternative composite filtration/carrier mechanism.
Figure 7B:
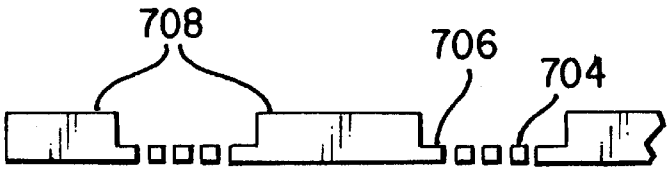
FIG. 7*b* is a cross-sectional side view taken along line 7*b*—7*b* of the alternative composite filtration/carrier mechanism of FIG. 7*a*.

FIG. 7*a* is a perspective view of an alternative composite filtration/carrier mechanism. FIG. 7*b* is a cross-sectional side view taken along line 7*b*—7*b* of the alternative composite filtration/carrier mechanism of FIG. 7*a*. Alternatively, the microscreen filter 500 and the filter carrier 600 of FIGS. 5 and 6*a* can be a composite filter/carrier 700, as shown in FIG. 7*a*. The composite filter/carrier 700 can be integrally formed by casting, milling, or laser machining (any other suitable technique can be used) an initial block of material to form the composite.

In a preferred embodiment similar to the microscreen filter 500 of FIG. 6*b*, the composite filter carrier 700 has a plurality of tapered micro apertures 704, and similar to the filter carrier 600 of FIG. 6*a*, the composite filter carrier 700 has a plurality of holes 706 facilitating fluid access to the micro apertures 704. The plurality of holes 706 defines thickened regions 708 which overcome any fragility problems that might be associated with the microscreen filter 500 as a micro thin sheet. Thus, the composite filter/carrier 700 provides stable and reinforced filtration of microfine particulate contamination without undue ink flow restriction, like the microscreen filter 500 and filter carrier 600 combination of FIGS. 6*a* and 6*b*. Again, by appropriately sizing and holes 704, the holes 704 can provide a prefiltering function.

Thermal Filter with Heat Transfer Device

Figure 9:
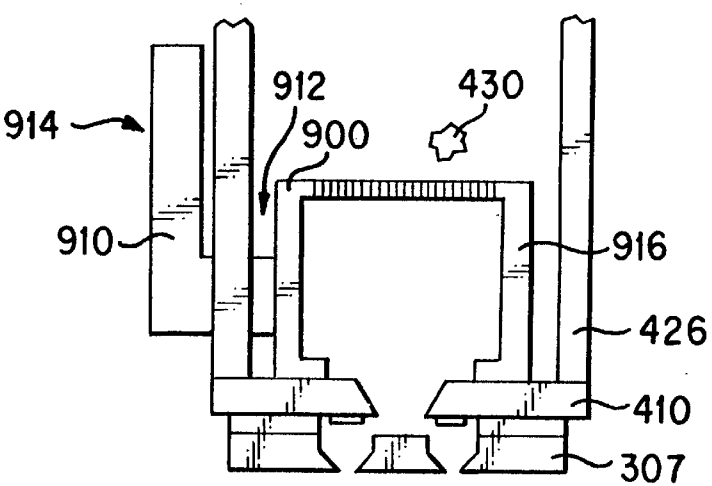
FIG. 9 is a schematic cross-sectional view taken along line 4—4 of FIG. 3 showing an alternative filtration/heat exchanger and an external heat transfer device.
Figure 10:
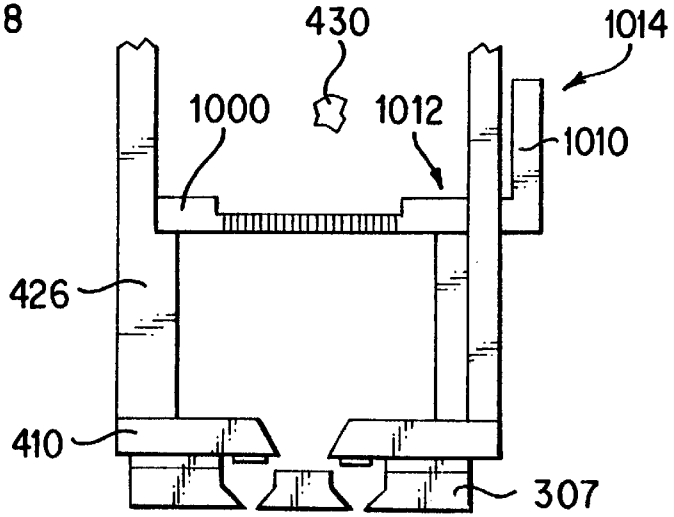
FIG. 10 is a schematic cross-sectional view taken along line 4—4 of FIG. 3 showing the filtration mechanism thermally coupled to an external heat transfer device.
Figure 8:
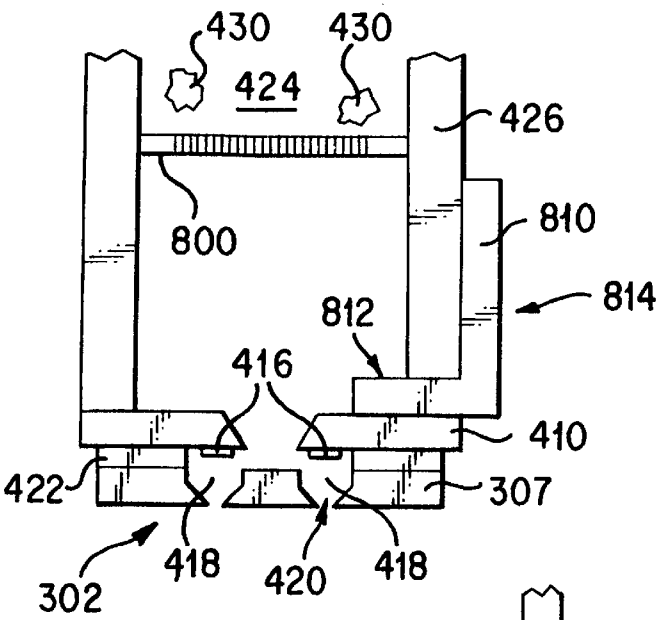
FIG. 8 is a schematic cross-sectional view taken along line 4—4 of FIG. 3 showing the filtration mechanism and an alternative external heat transfer device.

FIGS. 8–10 illustrate various configurations of an alternative embodiment of the present invention. The filter 428 of FIG. 4 can be a thermally efficient filter 800 900, 1000, as shown in FIGS. 8–10, respectively. The nozzle member 307, substrate 410, ink ejection elements 416, vaporization chambers 418, orifices 420, barrier layer 422, ink reservoir 424, housing 426 and particulate contamination 430 of FIG. 4 are similar to corresponding elements shown in FIGS. 8–10, hence, their descriptions are not discussed in the description that follows for FIGS. 8–10.

FIG. 8 is a schematic cross-sectional view taken along line 4—4 of FIG. 3 showing the filtration mechanism and an alternative external heat transfer device. FIG. 9 is a schematic cross-sectional view taken along line 4—4 of FIG. 13 showing an alternative filtration/heat exchanger and an external heat transfer device. FIG. 10 is a schematic cross-sectional view taken along line 4—4 of FIG. 3 showing the filtration mechanism thermally coupled to an external heat transfer device.

In general, thermally efficient filters 800, 900 and 1000 of FIGS. 8–10 can have heat transfer devices 810, 910, 1010, respectively, thermally coupled to the printhead 302. For example, the heat transfer devices 810, 910, 1010 are fixedly attached within the printhead 302 at an inner location of the housing 426 in close proximity to the substrate 410, and extend outside one or both of outside walls of the housing 426 to an external location 814, 914, 1014, respectively. These arrangements enable the heat transfer devices 810, 910, 1010 to be indirectly connected and in close proximity to the heat generating source, the ink ejection elements 416. With these arrangements, heat generated by the ink ejection elements 416 can be easily transferred via a thermal conduction path to an external location on an outside portion of the printhead. For instance, the thermal conduction path can be defined by heat moving from intake positions 812, 912, 1012, respectively, located near the heat source, to outtake positions located at external locations 814, 914, 1014, respectively.

Specifically, FIG. 8 shows a filter 800 with an external heat transfer device 810. The heat transfer device 810 is in direct contact with the substrate 410, which allows heat to be directly removed from the substrate 410 via the thermal conduction path defined by intake position 812 to outtake position 814, thereby preventing overheating of the printhead. The filter 800 is preferably the microscreen filter 500 described above in FIG. 5.

Alternatively, FIG. 9 shows a filter 900 integrated with a heat exchanger 916. The heat exchanger 916 is in direct contact with the substrate 410 and is thermally connected to an external heat transfer device 910. This arrangement allows heat to be transferred from not only the substrate 410, but also the filter 900, to an external location 914 of the printhead housing 426. Thus, heat buildup near the substrate 410 is removed and regulated. The filter 900 is preferably the microscreen filter 500 described above in FIG. 5.

FIG. 10 shows a filter 1000 integrated and thermally connected with a heat transfer device 1010 and in close proximity to the substrate 410. This arrangement allows heat to be transferred from the filter 1000 and general areas within the printhead to an external location 1014 of the printhead housing 426. Hence, printhead overheating is controlled. The filter 1000 is preferably the composite filter/carrier 600 described above in FIGS. 7–7*b*.

The external heat transfer devices 810, 910, 1010 of FIGS. 8–10 can be selected from various heat transfer mechanisms, such as heat pipes, cooling fins, heat sinks, etc., or any combination thereof. Also, to enhance heat transfer, forced convection via a fan or source of coolant (not shown) can be provided. Thermal efficiency is achieved by regulating printhead temperatures with the heat transfer devices 810, 910, 1010, while also filtering unwanted particles with the corresponding filters 800, 900, 1000, respectively. As a result, printhead overheating is prevented and particulate contamination is reduced to allow very high throughput rates for an inkjet printer.

The foregoing has described the principles, preferred embodiments and modes of operation of the present invention. However, the invention should not be construed as being limited to the particular embodiments discussed. As an example, the above-described inventions can be used in conjunction with inkjet printers that are not of the thermal type, as well as inkjet printers that are of the thermal type. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A printing system comprising:

an inkjet printhead;

a filter having a plurality of microfine apertures and being fluidically coupled to the inkjet printhead;

a filter member having a plurality of holes in fluid communication with microfine apertures of the filter; and a heat transfer device connected to the filter.

2. The printing system of claim 1, further comprising an ink supply for providing ink to the printhead and wherein the filter filters ink from the ink supply before the printhead dispenses the ink.

3. The printing system of claim 1, further comprising an ink supply coupled to the inkjet printhead for providing ink to the printhead.

4. The printing system of claim 1, further comprising a carriage supporting the printhead over a print media.

5. The printing system of claim 1, wherein the micro apertures are uniformly spaced apart.

6. The printing system of claim 1, wherein the micro apertures have uniform dimensions.

7. The printing system of claim 1, wherein the filter is connected to the filter member as an integrally formed composite filter.

8. The printing system of claim 7, further comprising a substrate having a front surface and an opposing back surface and ink ejection elements being formed on the front surface and the heat transfer device being in thermal contact with the back surface.

9. A printing system, comprising:

an ink supply;

an inkjet printhead for dispensing ink from the ink supply;

a microscreen filter having a plurality of apertures and being fluidically coupled between the ink supply and the inkjet printhead;

a filter member connected to the microscreen filter and having a plurality of holes larger than and in fluid communication with the plurality of apertures of the microscreen filter; and further comprising a heat transfer device connected to the microscreen filter and the filter member to define an integrally formed device.

10. A printing system comprising:

an inkjet printhead;

a filter; and a heat transfer device connected to the filter for thermally coupling the filter to the inkjet printhead.

11. The printing system of claim 10, further comprising an ink supply for providing ink to the printhead and wherein the thermal filter filters ink from the ink supply before the printhead dispenses the ink and while the heat transfer device transfers heat away from the printhead.

12. The printing system of claim 10, further comprising an ink supply coupled to the inkjet printhead for providing ink to the printhead.

13. The printing system of claim 10, further comprising a heat generating source located within the printhead, wherein the heat transfer device is attached to the heat generating source for removing heat from the printhead.

14. A printing method, comprising:

providing ink from an ink supply to an inkjet printhead for printing the ink;

fluidically coupling a thermal filter between the ink supply and the inkjet printhead, the thermal filter being comprised of a filter is connected to a heat transfer device as an integrated member for transferring heat from the printhead.

15. The method of claim 14, further comprising refilling the ink supply.

* * * * *